US005199578A

United States Patent [19]

Pendergraph et al.

[11] Patent Number: 5,199,578

[45] Date of Patent: Apr. 6, 1993

[54] CLIP STRIP FOR SUPPORTING MULTIPLE PACKAGES AND DISPLAY ASSEMBLY USING SAME

[75] Inventors: Melvin A. Pendergraph, Manchester; Richard G. Grainger, Cheshire; Edmund J. Czopor, Jr., Burlington, all of Conn.

[73] Assignee: The Stanley Works, New Britain, Conn.

[21] Appl. No.: 805,379

[22] Filed: Dec. 10, 1991

[51] Int. Cl.[5] ..... A47G 29/00

[52] U.S. Cl. ..... 211/72; 211/113; 206/482

[58] Field of Search ..... 211/71, 72, 113, 59.1, 211/54.1; 248/205.3, 221.4, 301; 206/482, 479, 806, 466; 24/698.2

[56] References Cited

U.S. PATENT DOCUMENTS

| | | | |
|---|---|---|---|
| 1,042,601 | 10/1912 | Rasch | 24/698.2 |
| 1,477,241 | 12/1923 | Carson | 206/482 |
| 1,588,002 | 6/1926 | Bishop | 24/698.2 X |
| 2,031,147 | 2/1936 | Doolin . | |
| 2,116,386 | 5/1938 | Copeland | 211/71 X |
| 2,532,022 | 11/1950 | Gunderson . | |
| 2,583,092 | 1/1952 | Dreyfus, Jr. . | |
| 2,743,021 | 4/1956 | Glenn | 211/72 X |
| 2,937,758 | 5/1960 | Tabb . | |
| 3,040,881 | 6/1962 | McNeill | 206/5 X |
| 3,392,426 | 7/1968 | Mathison et al. | 24/698.2 |
| 3,498,469 | 3/1970 | Hummel . | |
| 3,945,500 | 3/1976 | Meckstroth | 211/113 |
| 3,967,346 | 7/1976 | Young, Jr. . | |
| 4,291,810 | 9/1981 | Rubenstein . | |
| 4,312,449 | 1/1982 | Kinderman | 206/482 X |
| 4,461,387 | 7/1984 | Belokin, Jr. . | |
| 4,573,590 | 3/1986 | Ellis . | |
| 4,667,827 | 5/1987 | Calcerano | 211/59.1 X |
| 4,718,546 | 1/1988 | Kolton et al. | 211/113 X |
| 4,767,012 | 8/1988 | Simmons . | |
| 4,817,805 | 4/1989 | Rodriquez | 211/71 |
| 4,938,368 | 7/1990 | Sharman . | |
| 5,038,941 | 8/1991 | Bastiaansen . | |
| 5,096,070 | 3/1992 | Jayner | 211/71 |
| 5,103,970 | 4/1992 | Nielson et al. | 211/72 X |

FOREIGN PATENT DOCUMENTS

| | | | |
|---|---|---|---|
| 2945533 | 10/1916 | Fed. Rep. of Germany | 24/698.2 |

*Primary Examiner*—Carl D. Friedman
*Assistant Examiner*—Korie H. Chan

[57] ABSTRACT

A display assembly comprises a vertically disposed elongated planar strip of synthetic resin having a multiplicity of incisions spaced therealong which have spaced vertically extending legs and a transverse head portion extending between the upper ends thereof. The incisions provide upwardly extending tabs hinged to the body of the strip at their base between the lower ends of the legs. At least some of the tabs are deflected about their base outwardly of the plane of the body of the strip to form upwardly extending hooks, and articles of merchandise are supported on these hooks. The tabs have horizontally extending ears on their upper ends to securely seat in hanger apertures of blister cards and the like whereby one ear on one side of the tab is greater in length than an opposite ear on the other side of the tab. The strip has an aperture adjacent its upper end to receive a hanger prong to suspend the assembly.

9 Claims, 2 Drawing Sheets

CLIP STRIP FOR SUPPORTING MULTIPLE PACKAGES AND DISPLAY ASSEMBLY USING SAME

BACKGROUND OF THE INVENTION

The present invention relates to merchandise displays, and, more particulary, to a hanger strip with hooks supporting merchandise articles thereon.

Point of purchase displays have become a standard item in hardware and other stores wherein carded merchandise containing relatively small articles may be conveniently and attractively displayed. Frequently, perforated wallboard is provided on a wall of the store, and metal hangers having projecting prongs provide the supports for carded articles which have an aperture extending therethrough to receive the prong of the hanger.

It is common for the store to unpack the individual cards received in cartons and to place them individually upon the hangers located upon the board. Sometimes, this will require moving the hangers to accommodate changes in the size of the carded merchandise and in an effort to produce an attractive placement upon the board, depending upon the type of articles and size of the cards. In this type of display, mounting of individual carded articles on hangers usually exposes portions of the underlying perforated wallboard and this may be aesthetically desirable. It also requires that the wallboard have substantial vertical height if a large number of articles are to be displayed.

In still other instances, it is desirable to suspend merchandise on other types of structures such as on a counter mounted stand or from the edges of shelving and the like, and the same problems with respect to unpacking and placing the merchandise in these other areas will frequently be encountered.

It is an object of the present invention to provide a novel display assembly in which a multiplicity of articles of merchandise are conveniently supported upon an integrally formed strip member.

It is also an object to provide such a display assembly which may be assembled in the factory and shipped in cartons for ready removal therefrom as a unit, thus reducing the time necessary for unpacking and displaying the merchandise.

Another object is to provide such a display assembly utilizing a support strip which may be fabricated readily and economically from synthetic resin sheet material.

SUMMARY OF THE INVENTION

It has now been found that the foregoing and related objects may be readily attained in a display assembly including a vertically disposed elongated planar strip of synthetic resin having a multiplicity of incisions spaced therealong. These incisions have horizontally spaced vertically extending legs and a transverse head portion extending between the upper ends thereof. The incisions provide upwardly extending tabs hinged to the body of the strip at their base between the lower ends of the legs. In use, at least some of the tabs are deflected about their base outwardly of the plane of the body of the strip to form upwardly extending hooks, and individual articles of merchandise are supported on the hooks.

Preferably, the tabs have horizontally outwardly extending ears at the head portion thereof and desirably one of the ears is of greater horizontal dimension than the other. The strip has an aperture therein adjacent its upper end for suspending the strip from a hanger prong or the like. In the preferred structure, the incisions also have horizontally outwardly extending foot portions at the lower end of the legs to provide a flexure line.

Usually, the articles of merchandise include a mounting card for the merchandise article, and the card has an aperture therein through which the hook on the strip extends. The synthetic resin strip is self-supporting and exhibits limited resilient deflectability. Preferably, the synthetic resin is a polyolefin.

DETAILED DESCRIPTION OF THE PREFERRED EMBODIMENT

Figure 1:
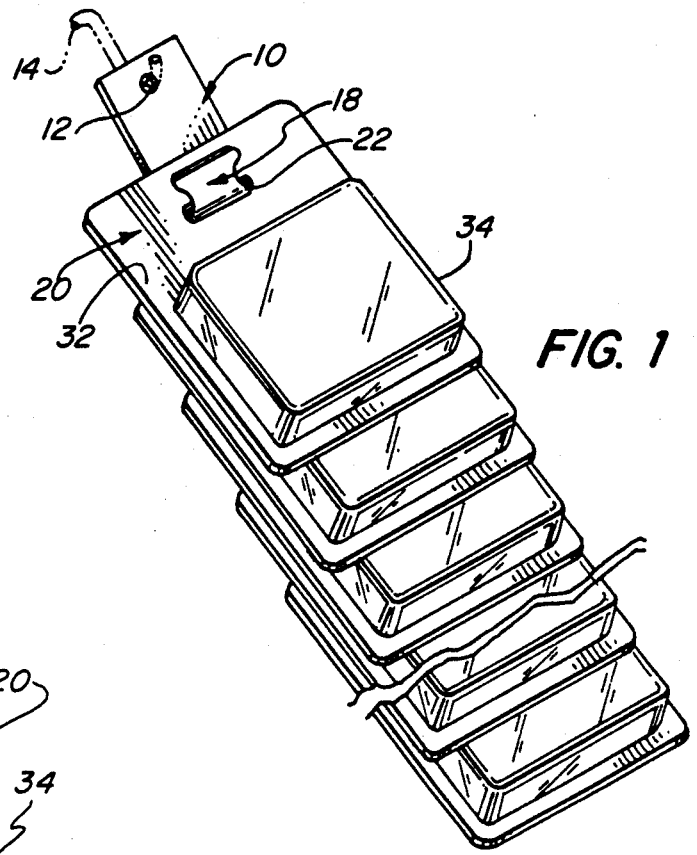
FIG. 1 is fragmentary perspective view of a display assembly embodying the present invention as suspended from a hanger prong shown in phantom line.
Figure 2:
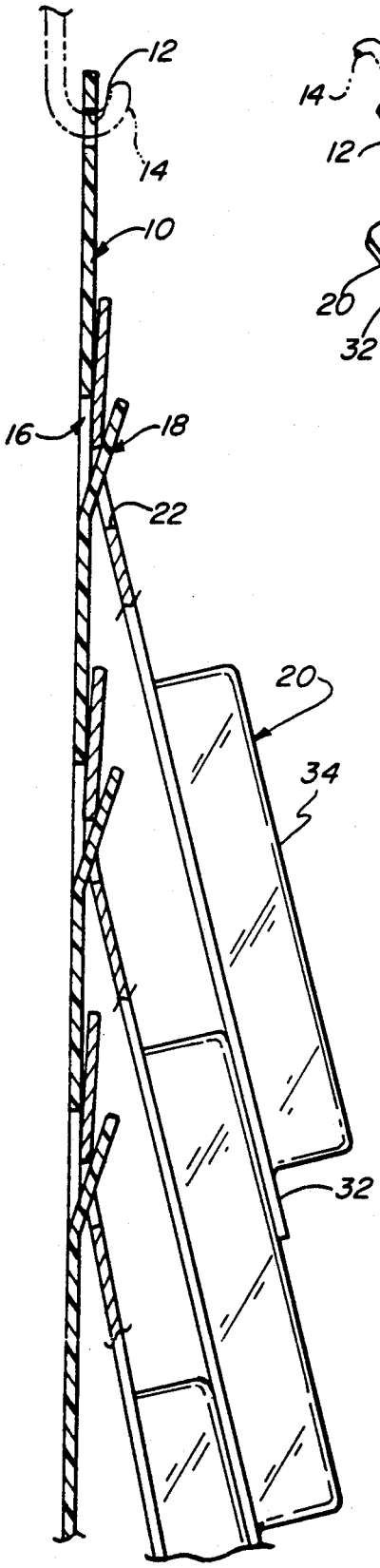
FIG. 2 is a fragmentary side elevational view thereof drawn to an enlarged scale.
Figure 3:
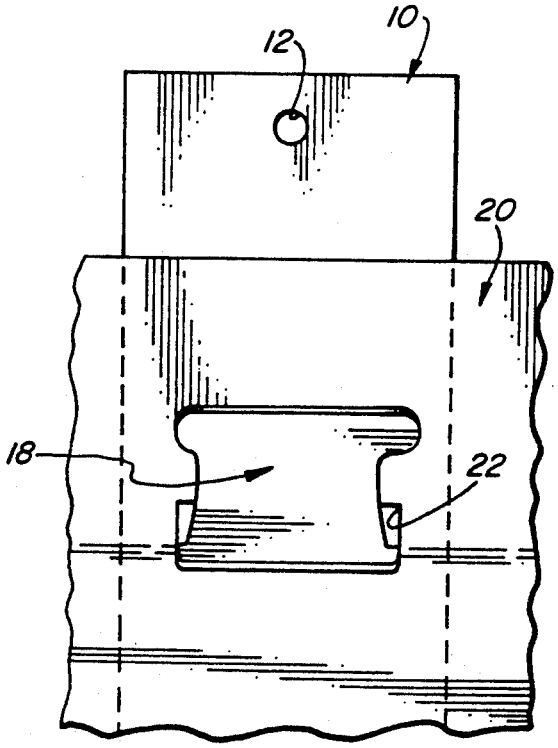
FIG. 3 is a fragmentary plan view of the upper portion of the display assembly of FIG. 1 drawn to an enlarged scale.

Turning first to FIGS. 1-3, therein illustrated is a display assembly embodying the present invention and comprised of an elongated synthetic resin hanger strip generally designed by the numeral 10 and having an aperture 12 adjacent its upper end. As shown, the aperture 12 seats the prong 14 of a hanger of the type which is conventionally employed in connection with perforated wallboard used in point of purchase displays.

At spaced points along the length of the strip 10 is a series of incisions generally designated by the numeral 16 which define tabs generally designated by the numeral 18. These tabs 18 are deflected outwardly from the plane of the body of the strip 10 to provide hooks which extend through the mounting apertures 22 of the articles of merchandise generally designated by the numeral 20. In the illustration, the article of merchandise 20 employs a paperboard card 32 and a thermoformed plastic blister 34 within which the actual product is enclosed.

Figure 4:
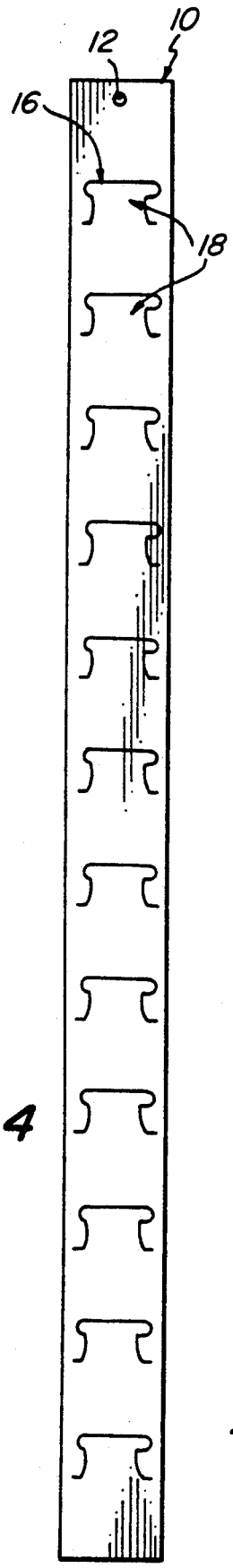
FIG. 4 is a plan view of the hanger strip of FIG. 1.
Figure 5:
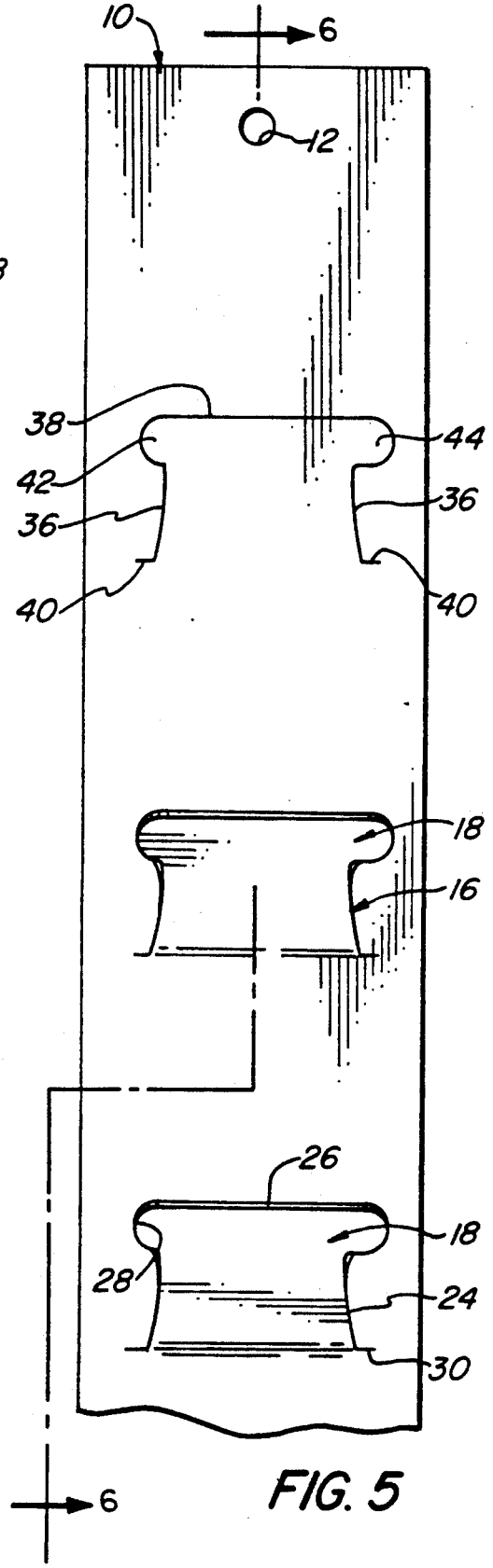
FIG. 5 is a fragmentary plan view drawn to an enlarged scale of the hanger strip of FIG. 4 and with the two lower tabs deflected from the plane of the strip.
Figure 6:
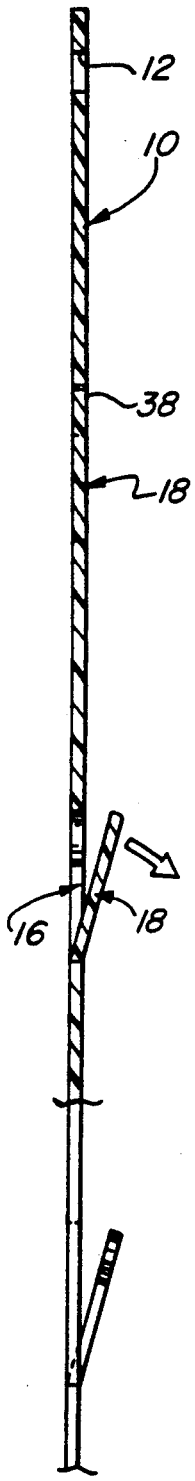
FIG. 6 is a fragmentary sectional view of the hanger strip of FIG. 5 along the section line 6—6.

Turning next to FIGS. 4-6, and particularly the uppermost incision 16 in FIG. 5, it can be seen that the incisions 16 have a pair of legs 36 spaced transversely of the strip 10 and extending generally along the longitudinal axis thereof and an enlarged transverse head portion 38 extending between the ends thereof closest to the support aperture 12. The head portion 38 has horizontally projecting ears 42, 44 which extend outwardly of the legs 36, for a purpose to be described more fully hereinafter. At the opposite or lower end of the legs 40 are short horizontally extending feet 30.

As can be seen in FIG. 6, the tab 18 may be deflected outwardly from the plane of the body of the strip 10, as shown by the arrow, into the position shown wherein it is extending upwardly and outwardly. The tab 18 has elongated sides 36 and an enlarged head portion 38 with ears 42, 44 and a hinge line 40. As can be seen, the feet 30 of the incision 16 facilitate the deflection of the tab 18 and minimize the tendency of the strip 10 to tear.

In this deflected position, the card 32 may be easily placed over the tab 18, and it will slide downwardly along its sides 24 to a point adjacent the base of the tab 18.

As will be noted in FIG. 5, the ears 42, 44 are of unequal size. This affords the advantage of more securely seating the carded package 20 upon the tab 18 since the package 20 must generally be canted to effect its removal from the tab 18.

As will be readily appreciated, the hanger strips of the present invention may be readily fabricated by die cutting the incisions and the hanger aperture in synthetic resin sheet material of the desired length and width. The spacing between the incisions may be varied depending upon the size of the cards to be supported thereon, and the sizes of the incisions may be varied depending upon the width and the length of the tabs which are desired.

By use of incisions of the type illustrated with arcuate ears and lateral feet, the tendency for the plastic strip to tear or split is minimized. By sloping the sides of the tabs towards their base as shown, the load from the carded merchandise tends to be applied at a point close to the base of the tabs, thus reducing any tendency for the tab to be deflected further by the weight of the carded article which is supported thereon.

In practice, the commercial embodiment of the invention employed by Applicants' assignee utilizes polyethylene strip having a thickness in the range of 0.030 to 0.050 inch, and preferably about 0.035 inch. A length of plastic sheet material 30–32 inches in length and 2 to 2½ inches in width will conveniently provide twelve tabs along its length, each tab having a height of about one inch. This will accommodate some variation in the size of the cards placed thereon while maintaining a desirable overlap of the cards to provide an attractive display.

Although polypropylene and ethylene/propylene copolymers may be employed, polyethylene is preferred because of its low cost and a desirable balance of properties. Other resins providing self-supporting properties and limited resilient deflectability may also be employed, albeit at greater cost. Desirably, the resin may be colored to improve aesthetics.

Display strips are preassembled with the merchandise and conveniently packed in shipping cartons so that the clerk removes the assembled strip and mounts twelve carded items at a time rather than removing them individually and individually mounting twelve items on hangers. It will be appreciated that shorter wallboards may be employed since the strips may hang therebelow. Problems in variation of vertical spacing generally found with use of individual hangers for the separate products may be substantially reduced.

Thus, it can be seen from the foregoing detailed description and attached drawings that the display assembly of the present invention is one which is attractive, economical and labor saving. The hanger strip may be readily fabricated from low cost synthetic sheet material by a simple die cutting operation, and a multiplicity of articles may be readily assembled upon the strip and packed in the shipping cartons at the factory.

Having thus described the invention, what is claimed is:

1. A display assembly comprising:

(a) a vertically disposed elongated planar strip of synthetic resin having upper and lower ends and having a multiplicity of incisions spaced therealong, said incisions defining upwardly extending tabs which includes a pair of horizontally spaced vertically extending legs whereby each of said legs has an upper end and a lower end, a transverse head portion extending between the upper ends of said legs, and a base extending between the lower ends of said legs, whereby said base is hinged to said planar strip, at least some of said tabs being deflected about their base outwardly of the plane of said strip to form upwardly extending hooks, said tabs having horizontally outwardly extending ears at the head portion thereof with one of said ears having greater horizontal dimension than the other ear; and (b) apertured articles of merchandise supported on said hooks.

2. The display assembly in accordance with claim 4 wherein said strip has an aperture therein adjacent its upper end for suspending said strip upon a hanger.

3. The display assembly in accordance with claim 1 wherein said incisions have horizontally outwardly extending foot portions at the lower end of said legs.

4. The display assembly in accordance with claim 1 wherein said articles of merchandise include a mounting card for the merchandise article, said card having an aperture therein through which said hook extends.

5. The display assembly in accordance with claim 1 wherein said synthetic resin is a polyolefin.

6. A packaging and display assembly comprising:

(a) a shipping carton;

(b) a multiplicity of elongated planar strip of synthetic resin having upper and lower ends, each of said planar strips comprising a multiplicity of incisions spaced therealong, said incisions defining upwardly extending tabs which includes a pair of horizontally spaced vertically extending legs whereby each of said legs has an upper end and a lower end, a transverse head portion extending between the upper ends of said legs, and a base extending between the lower ends of said legs, whereby said base is hinged to said planar strip, at least some of said tabs being deflected about their base outwardly of the plane of said strip to form upwardly extending hooks, said tabs having horizontally outwardly extending ears at the head portion thereof with one of said ears having greater horizontal dimension than the other ear; and (b) apertured articles of merchandise supported on said tabs of said strips in said carton, said strips being removable from said carton with said articles of merchandise remain securely supported on said strip for hanging on a merchandising display.

7. The packaging and display assembly in accordance with claim 6 wherein each said strip has an aperture therein adjacent its end oriented in the direction of said head portions for suspending said strip upon a hanger.

8. The packaging and display assembly in accordance with claim 6 wherein said incisions have horizontally outwardly extending foot portions at said other end of said legs.

9. The packaging and display assembly in accordance with claim 6 wherein said synthetic resin is a polyolefin.

* * * * *